US005317970A

United States Patent [19]

Nüssel et al.

[11] Patent Number: 5,317,970

[45] Date of Patent: Jun. 7, 1994

[54] METHOD AND SYSTEM FOR REVERSIBLY REGENERATING AN IMAGED PLANOGRAPHIC PRINTING FORM, PARTICULARLY FOR USE IN OFFSET PRINTING

[75] Inventors: Barbara Nüssel, Stätzling; Hartmut Fuhrmann, Karlsfeld; Horst Dauer, Rohrbach; Reinhard Plaschka, Munich, all of Fed. Rep. of Germany

[73] Assignee: MAN Roland Druckmaschinen AG, Offenbach am Main, Fed. Rep. of Germany

[21] Appl. No.: 899,337

[22] Filed: Jun. 16, 1992

[30] Foreign Application Priority Data

Jul. 19, 1991 [DE] Fed. Rep. of Germany ..... 4123959

[51] Int. Cl.[5] ..... B41N 1/00

[52] U.S. Cl. ..... 101/478; 101/467

[58] Field of Search ..... 101/463.1, 465, 466, 101/467, 478, 425; 346/159

[56] References Cited

U.S. PATENT DOCUMENTS

| | | | |
|---|---|---|---|
| 4,036,136 | 7/1977 | Takagi | 101/467 |
| 4,292,397 | 9/1981 | Takeuchi et al. | 101/466 |
| 4,347,785 | 9/1982 | Chase et al. | 101/467 |
| 4,718,340 | 1/1988 | Love, III | 101/467 |
| 4,777,109 | 10/1988 | Gumbinner et al. | 430/155 |
| 5,045,697 | 9/1991 | Schneider | 250/316.1 |
| 5,062,364 | 11/1991 | Lewis et al. | 101/467 |
| 5,129,321 | 7/1992 | Fadner | 101/467 |
| 5,187,046 | 2/1993 | Patrick et al. | 101/459 |

FOREIGN PATENT DOCUMENTS 3713801 11/1988 Fed. Rep. of Germany .

OTHER PUBLICATIONS

Journal of Vacuum Science and Technology: Part B, vol. 9. No. 2 Mar./Apr. 1991, New York, article by S. Fujimura et al.

*Primary Examiner*—Edgar S. Burr
*Assistant Examiner*—Stephen R. Funk
*Attorney, Agent, or Firm*—Frishauf, Holtz, Goodman & Woodward

[57] ABSTRACT

To remove hydrophobic particles from the surface of a hydrophilic printing plate, particularly when the printing plate is used in offset printing, an ionized reactive gas is conducted to the surface of the printing plate, and applied thereto, to cause the hydrophobic particles to form volatile reaction products, which are then removed by suction. The gas can be generated either in a burner, preferably supplied with an oxygen/hydrogen mixture, emitted from nozzles spaced between 10 to 50 mm from the printing plate, in which the printing plate and nozzle are relatively moved at a rate of about 20 mm/sec; or, alternatively, the ionized gas is generated in form of a plasma by a plasma generator, for example a magnetron, operating at 2.45 GHz, which plasma is conducted to the surface of the printing plate in a reaction chamber which is physically sealed with respect to the printing plate, so that the reaction with the hydrophobic particles can there occur. The reaction chamber is coupled to a high-vacuum pump, to maintain a vacuum in the order of about 0.5 mbar above the printing plate and within the reaction chamber.

9 Claims, 2 Drawing Sheets

METHOD AND SYSTEM FOR REVERSIBLY REGENERATING AN IMAGED PLANOGRAPHIC PRINTING FORM, PARTICULARLY FOR USE IN OFFSET PRINTING

Reference to related patent, assigned to the assignee of the present application, the disclosure of which is hereby incorporated by reference:

U.S. Pat. No. 5,045,697, Schneider.

Reference to related publication:

German Patent 37 13 801, Alexander.

FIELD OF THE INVENTION

The present invention relates to rotary printing machines, and more particularly to a method and a system to regenerate imaged planographic printing forms or printing plates, so that, after a prior imaging, they can be erased and re-used and re-imaged. This method and system is for reversibly regenerating an imaged planographic printing form. Such printing forms are particularly suitable for use in offset printing, in which a hydrophilic printing form has hydrophobic or oleophilic deposits thereon, representing the image to be printed, which is to be removed, for subsequent regeneration.

BACKGROUND

It is known to transfer information on a printing place suitable for offset printing directly from electronically stored information. The printing plate may be separate from or on a printing cylinder. For example, such information which may contain printed texts, drawings, figures, images or pictures, can be transferred to an anodized aluminum plate which has a hydrophilic surface. In accordance with the image to be printed or to be transferred, organic substances which are ink-accepting, or oleophilic, are transferred on portions of the printing plate surface by an image transfer unit, in accordance with digitally controlled image information. Particles which are transferred to the plate have oleophilic characteristics, to thereby mark the portions which are to be inked. The previously hydrophilic surface of the plate is then, where ink is to be transferred, rendered hydrophobic.

The referenced U.S. Pat. No. 5,045,697, Schneider, discloses a method and system which utilizes a thermal transfer process for transferring image information. Other arrangements and systems may be used, for example ink jet applicators or electrostatic application of particles. The printing form can be a printing plate, preferably an anodized, hydrophilic aluminum plate, or a printing cylinder having an outer jacket which has hydrophilic characteristics. The printing cylinder may have a Jacket made of ceramic, preferably $Al_2O_3$, as well as $Cr_2O_3$, $ZrSiO_4$, or an aluminum-magnesium silicate; it may, also, be a ceramic or glass cylinder, which can be massive, for example.

Directly imaged printing forms have to be capable of being re-used frequently. This requires that an imaged form should be capable of being regenerated, that is, the image once applied to the printing form, after printing, must be removed, or erased therefrom, so that a new printing image can be applied. Thus, the entire printing surface, after printing of a first image, must again be rendered hydrophilic over its entire circumference.

Cleaning methods well known from surface technology frequently have the disadvantage that cleaning has to be carried out in multiple stages or steps, and that the material is mechanically or abrasively stressed. Aluminum surface, in particular, when used as printing plates and which are to be rendered hydrophilic throughout the entire surface require a plurality of method steps, which is expensive. Some of the cleaning materials, additionally, cause problems in regeneration or disposal, for recycling in an environmentally acceptable manner.

THE INVENTION

It is an object to provide a method and a system to regenerate printing forms in which a previously applied image can be removed so that the entire printing form surface is rendered hydrophilic for subsequent re-imaging, without damage to the printing form or its surface, or attack of the surface, and which is simple to carry out and requires only a few process steps.

Briefly, hydrophobic particles are removed from a generally hydrophilic printing plate to render the entire surface of the printing plate hydrophilic by conducting an ionized reactive gas to the surface of the printing plate, and applying this gas to the surface of the printing plate to cause the hydrophobic particles to form volatile reaction products. The volatile reaction products, which are gaseous, are removed by suction. The apparatus includes a generator to generate the ionized reactive gas and a suction arrangement to remove the volatile reaction products.

Applying an ionized process gas to the printing form causes a reactive erasing process or removal process. A chemical reaction will occur at the surfaces of the material in which the organic particles are converted, essentially, to volatile or gaseous reaction products, such as water vapor and gaseous carbon dioxide ($H_2O$ and $CO_2$). The surface, thus, will become blank or erased. In this single processing step, the previous printing image is removed and, at the same time, the surface of the printing plate is regenerated, that is, rendered hydrophilic throughout its extent. It is believed that this is due to the formation of polar groups on the surface of the printing form, by oxidation due to the processing gas, and adsorption of the water vapor formed during the erasing process at the surface of the printing form.

The system and method of the present invention has the particular advantage that substantial quantities of acids or other solvents need not be used. It appears that, to obtain the chemical reaction at the surface of the printing plate, reactive species which are generated by high-frequency activation of the process gas, and resulting ultra-violet radiation, are responsible. The reactive species include oxygen ions and oxygen radicals. It appears that the resulting UV radiation and the reactive oxygen ions and radicals which are formed crack the organic, partially high molecular components of the material which was used to image the printing plate, by oxidative attack and/or photolithic attack. The volatile reaction products, which result are then removed by suction. This eliminates any physical engagement or attack on the surface of the printing plate as such.

Various reactive cleaning processes for the surfaces may be used. For example, low pressure plasma treatment, for instance corona treatment, irradiation by ultra-violet (UV) radiation, or treatment with an oxygen-hydrogen gas, or electrolytic or detonating gas flames may be used. Low-pressure plasma treatment is used in the automotive and packaging industry. Flame treatments are well known processes to improve the adhesive characteristics of surfaces, particularly plastic surfaces in painting or lacquering, printing, or coating. The semiconductor industry successfully uses plasma treatment for stripping of photo-resist lacquers and the like for surface cleaning.

DRAWINGS

DETAILED DESCRIPTION

Figure 1:
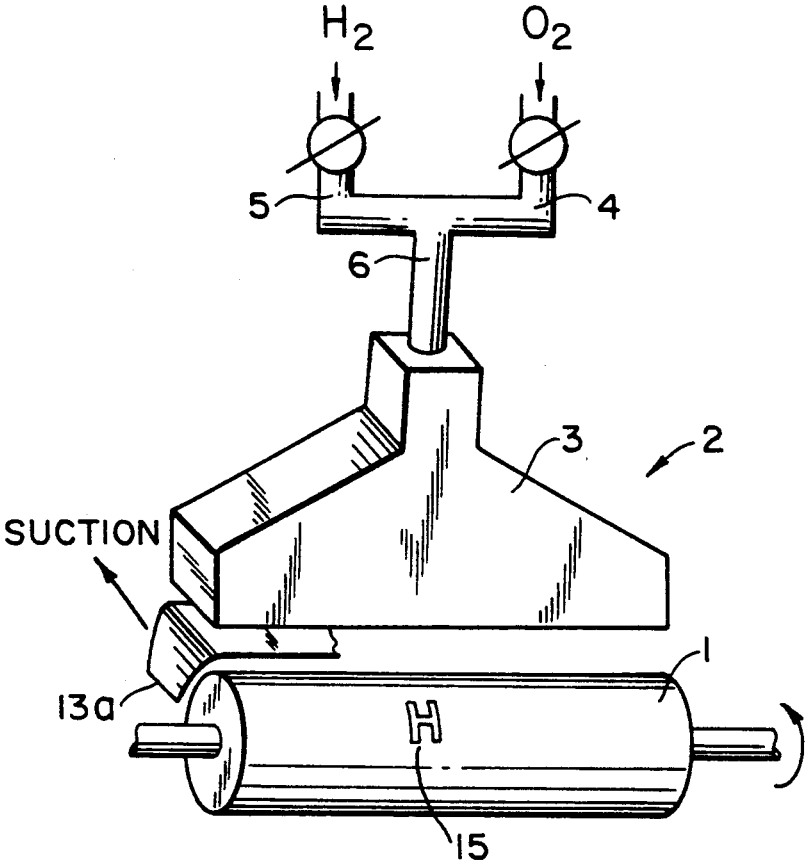
FIG. 1 illustrates an application of the method of the present invention, and an apparatus for carrying it out, using a combustible gas treatment for the surface of the printing cylinder.

A printing form cylinder 1 (FIG. 1) has an application apparatus 2 associated therewith. The application apparatus extends, essentially, over the entire axial length of the printing cylinder 1. It includes a distributed nozzle burner 3 to which gas lines 4, 5 extend. The printing cylinder 1 is rotated beneath the application apparatus 2. The gas lines supply hydrogen and oxygen, respectively, through suitable valves, and are combined in a line 6 which leads to the nozzle burner 3, for combustion. Upon combustion, organic components of the image applied to the cylinder are burned off. The reaction products, essentially, are $CO_2$ and water. The water forms the rehydrophilization of the surface of the printing form. The surface of the printing form is only slightly stressed.

Figure 2:
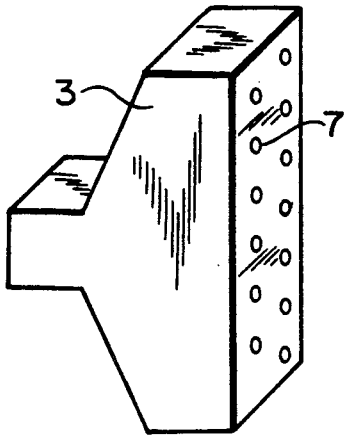
FIG. 2 is a detail view of an embodiment of a nozzle used in the apparatus of FIG. 1.

An image 15, schematically shown as the letter H, of a hydrophobic Substance is thus burned off. An oxygen-rich oxygen-hydrogen flame has been found particularly suitable. Preferably, the printing cylinder is moved beneath the burner 3 at a speed of about 20 mm per second. The spacing of the burner 3 to the surface of the cylinder 1, customarily, is from about 10 to 50 mm. To obtain erasing which is as uniform as possible, the nozzles 7 of the burner 3 are placed in two rows, which are offset with respect to each other, as seen in FIG. 2. The volatile reactive substances which occur upon reactive erasing of the substance particles from the surface of the form 1 are removed by a suction device 13*a*, only schematically shown in the drawing, and positioned downstream, with respect to the direction of rotation of the cylinder 1, from the application apparatus 2.

In the example illustrated, the burner 3 extends over the entire axial length of the printing form 1. Various changes may be made, for example a single-nozzle burner can be used, having an essentially point-directed nozzle opening, which is moved axially along the printing form as the printing form 1 rotates, so that the burner will affect the surface of the printing form 1 in a spiral path.

Figure 3:
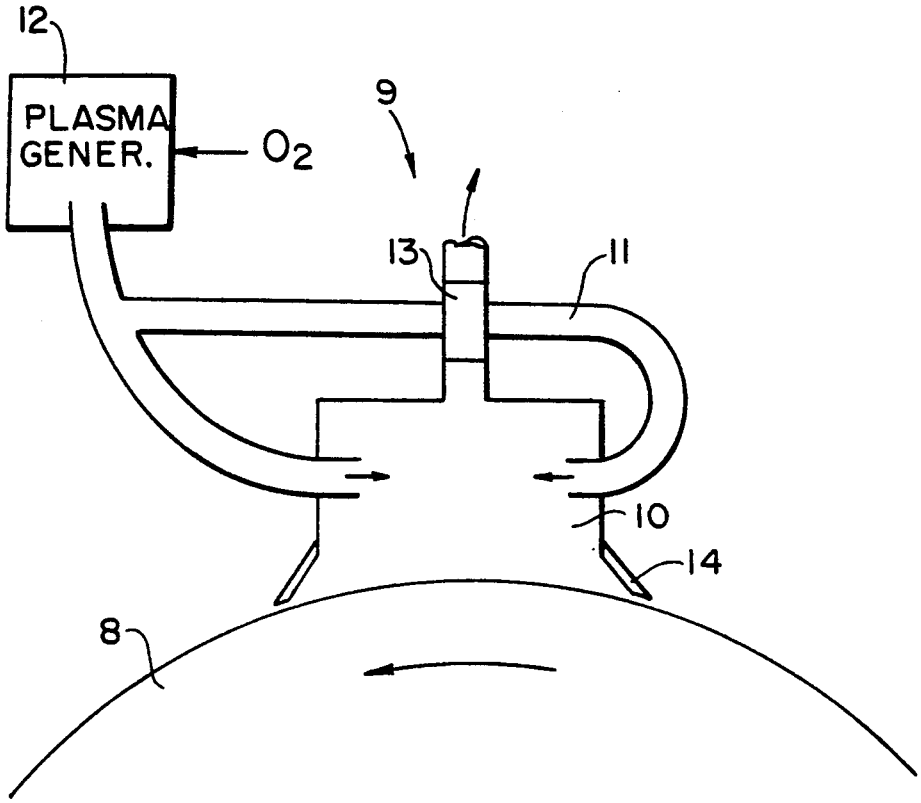
FIG. 3 is a highly schematic representation of a low-pressure plasma treatment apparatus to treat the surface of a printing cylinder.

Embodiment of FIG. 3

Another reactive method for regenerating the printing form is seen in detail in FIG. 3, in which a form cylinder 8 is moved beneath an application apparatus 9. The application apparatus 9, basically, includes a reaction chamber 10 which is located over the entire axial length of the printing cylinder 8. Gas lines 11 connect the reaction chamber 10 to a plasma-generating apparatus 12. The plasma-generating apparatus includes a resonant multiple oscillating chamber 12, which includes a high-frequency generator such as a magnetron. A suitable power rating is up to about 600 W. The plasma generating apparatus or chamber 12 receives gases at a pressure of from between 0.5 to 2 mbar, preferably at between about 0.8 to 1.4 mbar. A suitable reaction gas is oxygen, or a mixture of oxygen/$CF_4$. By applying a high-frequency alternating voltage in the GHz region, that is, in the microwave region, a gas discharge will be ignited. A preferred frequency is, for example, 2.45 GHz. A plasma is generated upon ignition which besides radicals includes ions, electrons, and neutral or uncharged reaction gas molecules. UV light also results as a consequence of the recombination processes.

The plasma is conducted through the lines 11 to the reaction chamber 10, which is evacuated by a high vacuum pump 13, to a level of about 0.5 mbar.

The surface of the printing form cylinder 8 provides the possibility to the chemical radicals to form new combinations or compounds. Oxygen specifics are immediately bound to the surface; polar surface groups will result, so that the surface energy of the printing cylinder is increased. This renders the surface hydrophilic. The chemical radicals, further and additionally, react with the organic material which has been applied in accordance with the previously printed image 15, to form volatile compounds which are removed by the vacuum pump 13.

The physical separation of the plasma generator 12 and of the reaction chamber 10 is due to the fact that it is difficult to form a microwave seal with respect to the rotating cylinder 8. If the plasma-generating chamber 12 and the reaction chamber 10 are separated, it is only necessary to provide a static microwave seal at the plasma generator 12. Sealing the reaction chamber 10 with respect to the rotating cylinder 12 then only requires a simple vacuum seal 14.

The low-pressure plasma treatment has a specific advantage, in that the reaction can be carried out in a temperature range of from between 30° C. to 100° C. At atmospheric pressure, this is possible only at several hundred degrees C. At the lower operating temperatures, damaging temperatures at the surface of the printing form 8 are readily avoided.

The seal 14 which seals the vacuum of the reaction chamber 10 with respect to the printing cylinder 8 can be made in any suitable manner well known from sealing technology of rotary devices, for example by using slide seals, or ferro fluids, which are placed in the gap between the housing of the reaction chamber 10 and the printing cylinder 8.

A pre-treatment of the imaged elements, for example using ultrasonics, in solvent or cleaning elements may be used to support the low-pressure plasma treatment. A subsequent or after treatment with ultrasonics to remove any loose particles still adhering to the surface may also be considered. Further treatment after the plasma treatment by UV radiation to prevent recontamination of the surface by organic contaminants can also be used, in order to ensure that the surface of the printing form, which can be easily wetted by hydrophobic particles remains wettable.

Simultaneous UV irradiation and plasma treatment further support the dissociation reaction due to the attack by free radicals.

Contrasting various possible surface treatments of a printing form in which a reaction gas is used with that of low-pressure plasma treatment, it is seen that the effects are very much alike. The effectiveness of the reaction at the low-pressure plasma treatment is somewhat higher. It appears that the reason is the higher lifetime of the active particles at low pressure. Plasma treatment in which the plasma is excited by microwaves is particularly effective, since the concentration of reactive species in a plasma, excited by microwaves, is higher than in plasmas which are excited at lower frequencies.

Various changes and modifications may be made within the scope of the inventive concept.

We claim:

1. A method for reversibly regenerating a planographic printing form used in offset printing, wherein the printing form comprises a hydrophilic printing plate on which hydrophobic particles are located, said method comprising removal of the hydrophobic particles and rendering the entire surface of the printing plate hydrophilic by the steps of:

conducting an ionized reactive gas in the form of a plasma to an evacuated reaction chamber which extends across the printing plate and is vacuum sealed with respect to the printing plate;

applying said ionized reactive gas to the surface of the printing plate for causing said ionized reactive gas and the hydrophobic particles to form gaseous volatile reaction products and simultaneously causing rehydrophilization of the hydrophilic surface due to exposure of the printing plate surface to the reaction products; and removing the gaseous volatile reaction products by suction.

2. The method of claim 1, including the step of generating the plasma in a plasma generator which is physically located separately from the reaction chamber; and guiding the plasma through gas lines from the plasma generator to the reaction chamber.

3. The method of claim 2, wherein said plasma generator comprises a high-frequency a-c generator, operating in the Giga Hertz (GHz) frequency range.

4. The method of claim 1, wherein said plasma is generated by using a gas selected from the group consisting of oxygen and an oxygen/$CF_4$ gas mixture.

5. The method of claim 1, wherein said reaction chamber is evacuated to a pressure of about 0.5 mbar.

6. A system for reversibly regenerating an imaged planographic printing plate for use in offset printing, wherein the printing plate comprises a hydrophilic surface on which hydrophobic particles are located, comprising:

means for removal of the hydrophobic particles and for rendering the entire surface of the printing plate hydrophilic, said means including:

an ionized reaction gas generating means for generating an ionized reaction gas, said ionized reaction gas generating means including a plasma generator;

an application means, including an evacuated chamber, coupled to the ionized reaction gas generating means for applying said gas to the surface of the printing plate to cause said ionized reaction gas and the hydrophobic particles to form gaseous, volatile reaction products and to simultaneously cause rehydrophilization of the hydrophilic surface due to exposure of the printing plate surface to the reaction products; and vacuum exhaust means for removing the gaseous reaction products.

7. The system of claim 6, wherein said plasma generator comprises a high-frequency generator; and said evacuated chamber is evacuated to a vacuum of about 0.5 mbar.

8. The system of claim 7, further including gas supply means coupled to the plasma generator and supplying at least one of: oxygen; a mixture of oxygen and $CF_4$; and wherein said high-frequency generator is operating at alternating current in a Giga Hertz (GHz) frequency range for igniting the gas and hence generating the plasma.

9. The system of claim 8, wherein said alternating current has a frequency of about 2.45 GHz.

* * * * *